US007567152B2

(12) United States Patent
Kimura et al.

(10) Patent No.: US 7,567,152 B2
(45) Date of Patent: Jul. 28, 2009

(54) PASSIVE PART

(75) Inventors: Hironobu Kimura, Saku (JP); Takami Hirai, Toyota (JP); Yasuhiko Mizutani, Komaki (JP); Masaki Urano, Saku (JP)

(73) Assignee: Soshin Electric Co., Ltd., Saku (JP)

( * ) Notice: Subject to any disclaimer, the term of this patent is extended or adjusted under 35 U.S.C. 154(b) by 159 days.

(21) Appl. No.: 11/574,627

(22) PCT Filed: Nov. 25, 2005

(86) PCT No.: PCT/JP2005/021735

§ 371 (c)(1),
(2), (4) Date: Mar. 2, 2007

(87) PCT Pub. No.: WO2006/057366

PCT Pub. Date: Jun. 1, 2006

(65) Prior Publication Data

US 2007/0279145 A1 Dec. 6, 2007

(30) Foreign Application Priority Data

Nov. 26, 2004 (JP) ..... 2004-343032

(51) Int. Cl.
*H01P 3/08* (2006.01)

(52) U.S. Cl. ..... 333/204; 333/185; 333/26

(58) Field of Classification Search ..... 333/26, 333/204, 185
See application file for complete search history.

(56) References Cited

U.S. PATENT DOCUMENTS 6,222,427 B1 4/2001 Kato et al.
6,828,881 B2 12/2004 Mizutani et al.
6,937,845 B2 8/2005 Watanabe et al.
7,068,122 B2 * 6/2006 Weng et al. ..... 333/26
7,348,868 B2 * 3/2008 Urano et al. ..... 333/204
2006/0192637 A1 8/2006 Urano et al.

FOREIGN PATENT DOCUMENTS

| | | | |
|---|---|---|---|
| EP | 1 304 761 | | 4/2003 |
| JP | 07-142914 | A1 | 6/1995 |
| JP | 08-335803 | A1 | 12/1996 |
| JP | 09-035936 | A1 | 2/1997 |
| JP | 10-028006 | A1 | 1/1998 |
| JP | 10-209726 | A1 | 8/1998 |
| JP | 2000-165171 | A1 | 6/2000 |
| JP | 2001-345729 | A1 | 12/2001 |
| JP | 2003-087008 | A1 | 3/2003 |
| JP | 2004-312065 | A1 | 11/2004 |

* cited by examiner

*Primary Examiner*—James Cho
(74) *Attorney, Agent, or Firm*—Burr & Brown

(57) ABSTRACT

A dielectric substrate includes a filter unit, a non-balance/balance conversion unit, and a connection unit for electrically connecting the filter unit to the non-balance/balance conversion unit which are formed in the dielectric substrate. A first resonator has an electrode formed on the main surface of a fourth dielectric layer and a via hole penetrating through a first to a third dielectric layers and connecting the electrode to a grounding electrode. A second resonator has an electrode formed on the main surface of the fourth dielectric layer and a via hole penetrating through the first to the third dielectric layers and connecting the electrode to the grounding electrode.

9 Claims, 6 Drawing Sheets

PASSIVE PART

TECHNICAL FIELD

The present invention relates to a passive part including a laminated dielectric filter for use in a resonating circuit in a microwave band ranging from several hundreds MHz to several GHz, and more particularly to a passive part designed for improved electric characteristics and a small size.

BACKGROUND ART

Radio communication systems in recent years employ many integrated circuits (ICs) for outputting an unbalanced signal. In such a radio communication system, an unbalanced signal output from an IC passes through a filter, and the unbalanced signal that has passed through the filter is converted into a balanced signal by an unbalanced to balanced converter (balun). Consequently, the number and size of passive parts used in the radio communication system are reduced, thereby reducing the size of and simplifying the radio communication system.

Attempts have heretofore been proposed to reduce the size of and simplify radio communication systems by (1) forming a filter and a balun integrally in a dielectric substrate, or (2) forming a λ/4 resonator and a λ/2 resonator integrally in a dielectric substrate, or (3) setting a frequency close to the frequency band used by the balun as an attenuation pole for efficiently attenuating signals outside of the passband (see Patent Document 1, for example).

According to another attempt to reduce the size of and simplify radio communication systems, a resonator is provided by a via hole formed in a dielectric substrate which comprises a plurality of laminated dielectric layers, the via hole extending in the laminated direction of the dielectric layers (see Patent Documents 2 through 6, for example).

Patent Document 1: Japanese Laid-Open Patent Publication No. 2003-87008;

Patent Document 2: Japanese Laid-Open Patent Publication No. 7-142914;

Patent Document 3: Japanese Laid-Open Patent Publication No. 8-335803;

Patent Document 4: Japanese Laid-Open Patent Publication No. 9-35936;

Patent Document 5: Japanese Laid-Open Patent Publication No. 10-28006; and

Patent Document 6: Japanese Laid-Open Patent Publication No. 2000-165171.

DISCLOSURE OF THE INVENTION

However, the above attempts suffer the following problems:

According to the attempt (1), since a filter and a balun are formed integrally in a dielectric substrate, the volume of the dielectric portion of the filter, particularly the vertical thickness thereof, is small. Thus, a conductor loss caused by an electrode in the dielectric substrate is large, tending to lower the Q value of a stripline resonator of the filer thereby to increase the loss of the passive part.

Specifically, if the resonator of the filter is constructed of a ground electrode disposed on the surface of the dielectric substrate and a planar resonant electrode disposed parallel to the ground electrode, then because the filter and the balun are integrally combined with each other, the resonant electrode and the ground electrode are positioned closely to each other, producing a large stray capacitance to lower the Q value of the resonator.

As the size of the dielectric substrate is reduced, the length of the resonant electrode is also reduced. In order that the resonant electrode has a certain length, the resonant electrode may be of a folded structure. However, the folded resonant electrode increases the conductor loss, further lowering the Q value of the resonator.

According to the attempt (2), the passive part is liable to become large in size because the λ/2 resonator is employed.

According to the attempt (3), if the frequency band for attenuating signals is wide, then there is a need to form many attenuation poles, which make it difficult to achieve a desired attenuation level.

In the passive part having the resonator provided by the via hole, the via hole extends in the laminated direction of the dielectric layers. If the via hole is used to construct a λ/2 resonator, then the passive part is likely to have an increased size in the laminated direction of the dielectric layers.

The attempts (2), (3) are therefore problematic in that they cannot meet market demands for smaller-size passive parts because the integral combination of the filter and the balun further increases the size of the passive part.

The present invention has been made in view of the above problems. It is an object of the present invention to provide a passive part which has increased electric characteristics, in particular a high Q value, even if the passive part is small in size, and which causes a small loss.

A passive part according to the present invention has, in a dielectric substrate with a ground electrode disposed thereon, a filter, an unbalanced to balanced converter, and a connector electrically interconnecting the filter and the unbalanced to balanced converter, wherein the filter has at least one resonator and the resonator has a via hole having an end connected to the ground electrode.

Since the via hole is connected to the ground electrode, no stray capacitance is produced between the via hole and the ground electrode. Furthermore, since the via hole can be of a greater cross-sectional area than planar electrodes, it causes a correspondingly smaller conductor loss, resulting in a higher resonator Q value. There is no need to increase the thickness of the dielectric material included in the filter. Accordingly, the passive part wherein the filter and the unbalanced to balanced converter are integrally combined with each other can be made smaller in size.

A passive part according to the present invention has, in a dielectric substrate, a filter, an unbalanced to balanced converter, and a connector electrically interconnecting the filter and the unbalanced to balanced converter, wherein the filter is disposed in an upper portion of the dielectric substrate and the unbalanced to balanced converter is disposed in a lower portion of the dielectric substrate, or the filter is disposed in a lower portion of the dielectric substrate and the unbalanced to balanced converter is disposed in an upper portion of the dielectric substrate, a first ground electrode is disposed on an upper or lower surface of the dielectric substrate close to the filter, and a second ground electrode is disposed on the other surface of the dielectric substrate close to the unbalanced to balanced converter, an innerlayer ground electrode is disposed between the filter and the unbalanced to balanced converter, the filter has at least one resonator, and the resonator has a via hole having an end connected to the first ground electrode, and an electrode connected to the other end of the via hole and positioned across a dielectric material from the innerlayer ground electrode.

The resonator is a ¼-wavelength resonator having a via hole connected to the first ground electrode. The resonator is disposed between the first ground electrode and the second ground electrode and extends perpendicularly to these ground electrodes. An end of the resonator which is connected to the first ground electrode serves as a short-circuited end. A portion, which faces the innerlayer ground electrode, of the first electrode which is disposed in facing relation to the innerlayer ground electrode serves as an open end. In other words, the ground electrode which provides the short-circuited end of the resonator, and the ground electrode which faces the open end of the resonator are different from each other.

According to the present invention, since the resonator has a via hole connected to the first ground electrode, the conductor loss is small and the resonator Q value is large. Accordingly, the passive part wherein the filter and the unbalanced to balanced converter are integrally combined with each other can be made smaller in size. Moreover, as the electrode of the resonator and the innerlayer ground electrode are disposed in facing relation to each other with a dielectric material interposed therebetween, a capacitance is provided between GND (ground) and the resonator. The ground electrode for providing the filter and the innerlayer ground electrode for providing isolation between the filter and the converter are provided as a common electrode, so that the electrodes disposed in the dielectric substrate are efficiently placed in position.

The connector may have a via hole electrically connected to the electrode of the resonator and extending through the innerlayer ground electrode, the via hole having an end connected to the unbalanced to balanced converter. Alternatively, the connector may have a capacitive electrode disposed across a dielectric material from the electrode of the resonator, and a via hole connected to the capacitive electrode and extending through the innerlayer ground electrode, the via hole having an end connected to the unbalanced to balanced converter.

A passive part according to the present invention has, in a dielectric substrate, a filter, an unbalanced to balanced converter, and a connector electrically interconnecting the filter and the unbalanced to balanced converter, wherein the filter is disposed in an upper portion of the dielectric substrate and the unbalanced to balanced converter is disposed in a lower portion of the dielectric substrate, or the filter is disposed in a lower portion of the dielectric substrate and the unbalanced to balanced converter is disposed in an upper portion of the dielectric substrate, a first ground electrode is disposed on an upper or lower surface of the dielectric substrate close to the filter, and a second ground electrode is disposed on the other surface of the dielectric substrate close to the unbalanced to balanced converter, an innerlayer ground electrode is disposed between the filter and the unbalanced to balanced converter, the filter has at least one resonator, and the resonator has a first via hole, a first electrode connected to an end of the first via hole and disposed in facing relation to the innerlayer ground electrode, a second electrode connected to the other end of the first via hole and disposed across a dielectric material from the first ground electrode, and a second via hole having an end connected to the second electrode and the other end connected to the innerlayer ground electrode.

The resonator is a ¼-wavelength resonator having the first and second via holes. The resonator is disposed between the first ground electrode and the second ground electrode and extend perpendicularly to these ground electrodes. The resonator is of a folded structure. An end of the resonator which is connected to the innerlayer ground electrode serves as a short-circuited end, and a portion, which faces the innerlayer ground electrode, of the first electrode which is disposed in facing relation to the innerlayer ground electrode serves as an open end. In other words, the ground electrode which provides the short-circuited end of the resonator, and the ground electrode which faces the open end of the resonator are the same as each other (the innerlayer ground electrode).

Since the resonator has a first via hole and a second via hole, the conductor loss is small and the resonator Q value is large. Accordingly, the passive part wherein the filter and the unbalanced to balanced converter are integrally combined with each other can be made smaller in size. Moreover, since the first electrode of the resonator and the innerlayer ground electrode are disposed in facing relation to each other with a dielectric material interposed therebetween, a capacitance is provided between GND (ground) and the resonator. The ground electrode for providing the filter and the innerlayer ground electrode for providing isolation between the filter and the converter are provided as a common electrode, so that the various electrodes disposed in the dielectric substrate are efficiently placed in position.

Since the resonator is of a folded structure provided by the first and second via holes, a required resonator length is achieved for a sufficiently lower resonant frequency even if the passive part is small in size.

According to the present invention, the connector may comprise a via hole electrically connected to the first electrode of the resonator and extending through the innerlayer ground electrode, the via hole having an end connected to the unbalanced to balanced converter. Alternatively, the connector may comprise a capacitive electrode disposed across a dielectric material from the first electrode of the resonator, and a via hole connected to the capacitive electrode and extending through the innerlayer ground electrode, the via hole having an end connected to the unbalanced to balanced converter.

A passive part according to the present invention has, in a dielectric substrate, a filter, an unbalanced to balanced converter, and a connector electrically interconnecting the filter and the unbalanced to balanced converter, wherein the filter is disposed in a left portion of the dielectric substrate and the unbalanced to balanced converter is disposed in a right portion of the dielectric substrate, or the filter is disposed in a right portion of the dielectric substrate and the unbalanced to balanced converter is disposed in a left portion of the dielectric substrate, a first ground electrode is disposed in an upper portion of the dielectric substrate, and a second ground electrode is disposed in a lower portion of the dielectric substrate, the filter has at least one resonator, and the resonator has a via hole having an end connected to the first ground electrode, and an electrode connected to the other end of the via hole and disposed across a dielectric material from the second ground electrode.

The resonator is disposed between the first ground electrode and the second ground electrode and extends perpendicularly to these ground electrodes. An end of the resonator which is connected to the first ground electrode serves as a short-circuited end. A portion, which faces the innerlayer ground electrode, of the electrode which faces the second ground electrode serves as an open end. In other words, the ground electrode which provides the short-circuited end of the resonator, and the ground electrode which faces the open end of the resonator are different from each other.

Accordingly, the passive part wherein the filter and the unbalanced to balanced converter are integrally combined with each other can be made smaller in size.

According to the present invention, in particular, because the filter is disposed in the left or right portion of the dielectric substrate, and the unbalanced to balanced converter is disposed in the right or left portion of the dielectric substrate, the dielectric material included in the filter can have a sufficient thickness for a higher resonator Q value.

According to the present invention, the connector may comprise a connecting electrode having an end electrically connected to the electrode of the resonator and the other end connected to the unbalanced to balanced converter, wherein an innerlayer ground electrode may be disposed between the connecting electrode and the unbalanced to balanced converter. Alternatively, the connector may comprise a capacitive electrode disposed across a dielectric material from the electrode of the resonator, and a connecting electrode having an end connected to the capacitive electrode and the other end connected to the unbalanced to balanced converter, wherein an innerlayer ground electrode may be disposed between the connecting electrode and the unbalanced to balanced converter.

A passive part according to the present invention has, in a dielectric substrate, a filter, an unbalanced to balanced converter, and a connector electrically interconnecting the filter and the unbalanced to balanced converter, wherein the filter is disposed in a left portion of the dielectric substrate and the unbalanced to balanced converter is disposed in a right portion of the dielectric substrate, or the filter is disposed in a right portion of the dielectric substrate and the unbalanced to balanced converter is disposed in a left portion of the dielectric substrate, a first ground electrode is disposed in an upper portion of the dielectric substrate, and a second ground electrode is disposed in a lower portion of the dielectric substrate, and the resonator has a via hole, a first electrode connected to an end of the via hole and disposed in facing relation to the second ground electrode, a second electrode connected to the other end of the via hole and disposed across a dielectric material from the first ground electrode, and a second via hole having an end connected to the second electrode and the other end connected to the second ground electrode.

The resonator is disposed between the first ground electrode and the second ground electrode and extend perpendicularly to these ground electrodes. The resonator is of a folded structure. An end of the resonator which is connected to the second ground electrode serves as a short-circuited end, and a portion, which faces the second ground electrode, of the first electrode which is disposed in facing relation to the second ground electrode serves as an open end. In other words, the ground electrode which provides the short-circuited end of the resonator, and the ground electrode which faces the open end of the resonator are the same as each other (the second ground electrode).

The passive part wherein the filter and the unbalanced to balanced converter are integrally combined with each other can be made smaller in size. Moreover, the various electrodes disposed in the dielectric substrate are efficiently placed in position. Because the filter is disposed in the left or right portion of the dielectric substrate, and the unbalanced to balanced converter is disposed in the right or left portion of the dielectric substrate, the dielectric material included in the filter can have a sufficient thickness for a higher resonator Q value.

Since the resonator is of a folded structure provided by the first and second via holes, a required resonator length is achieved for a sufficiently lower resonant frequency even if the passive part is small in size.

According to the present invention, the connector may comprise a connecting electrode having an end electrically connected to the first electrode of the resonator and the other end connected to the unbalanced to balanced converter, wherein an innerlayer ground electrode may be disposed between the connecting electrode and the unbalanced to balanced converter. Alternatively, the connector may comprise a capacitive electrode disposed across a dielectric material from the first electrode of the resonator, and a connecting electrode having an end connected to the capacitive electrode and the other end connected to the unbalanced to balanced converter, wherein an innerlayer ground electrode may be disposed between the connecting electrode and the unbalanced to balanced converter.

According to the present invention, as described above, even if the passive part is reduced in size, it has increased electric characteristics, in particular a high resonator Q value, and causes a small loss. Thus, the passive part wherein the filter and the unbalanced to balanced converter are integrally combined with each other can be made smaller in size.

BEST MODE FOR CARRYING OUT THE INVENTION

Certain embodiments of passive parts according to the present invention will be described below with reference to FIGS. 1 through 6.

Figure 1:
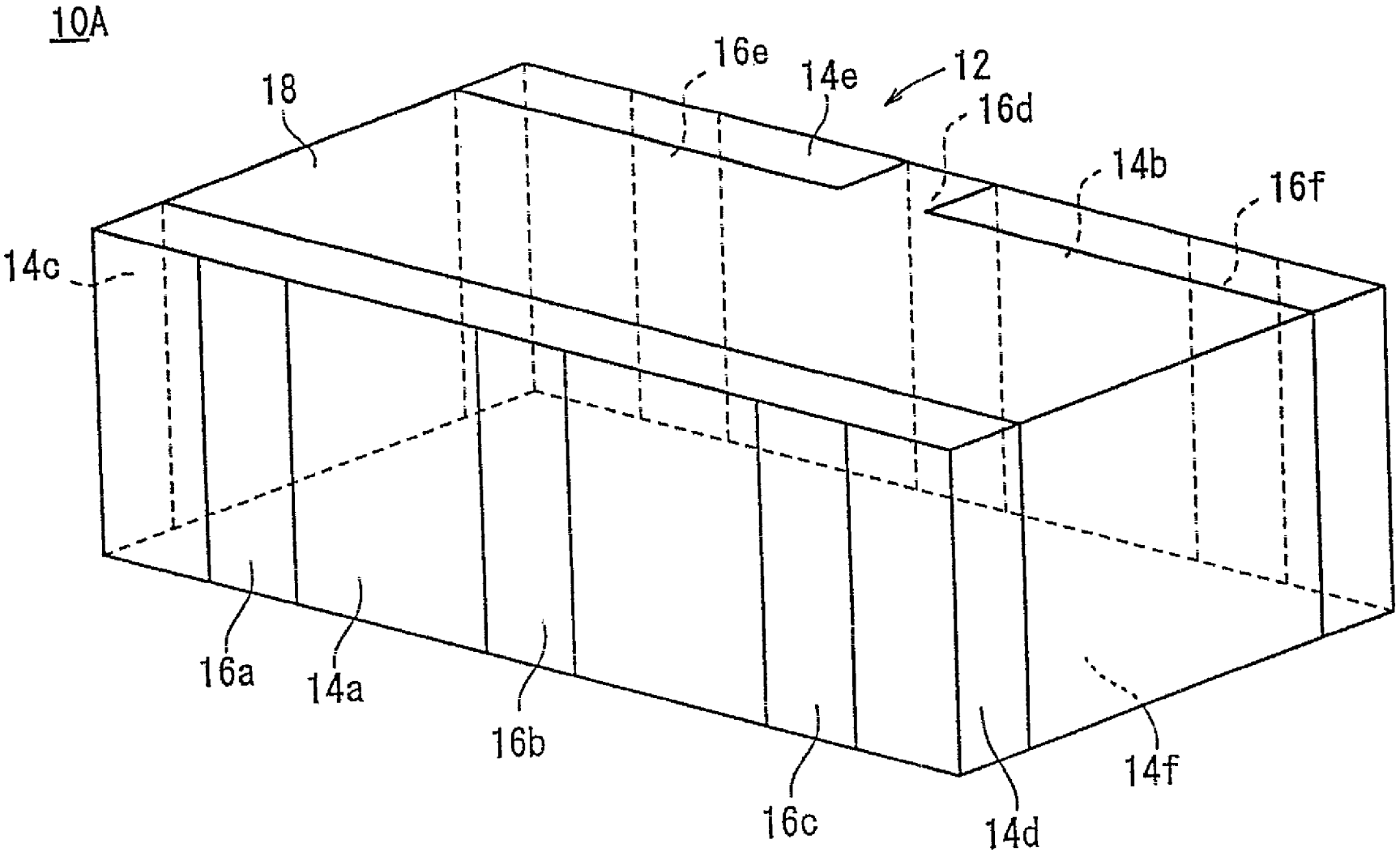
FIG. 1 is a perspective view of a passive part according to a first embodiment of the present invention.
Figure 2:
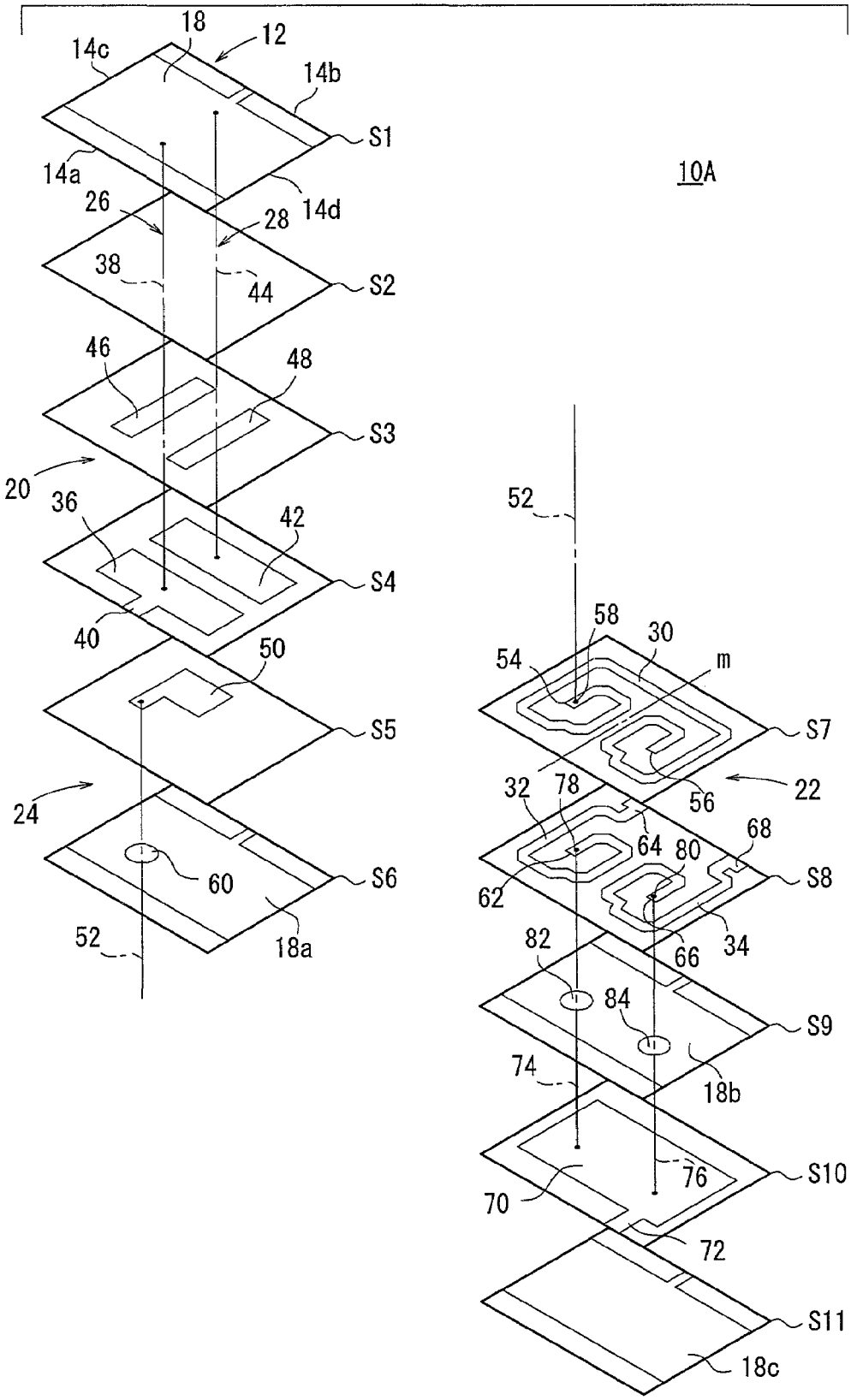
FIG. 2 is an exploded perspective view of the passive part according to the first embodiment.

As shown in FIGS. 1 and 2, a passive part 10A according to a first embodiment of the present invention has a dielectric substrate 12 comprising a plurality of dielectric layers S1 through S11 (see FIG. 2) which are laminated and baked integrally together. The dielectric substrate 12 has six outer peripheral surfaces (first through fourth side surfaces 14*a* through 14*d*, an upper surface 14*e*, and a lower surface 14*f*). A ground electrode 18 is disposed substantially entirely on the third and fourth side surfaces 14*c*, 14*d* and the upper surface 14*e* in covering relation to the dielectric substrate 12. According to the first embodiment, an innerlayer ground electrode 18*c* is disposed on a principal surface of the lowermost dielectric layer S11 as described below. Alternatively, the ground electrode 18 may be disposed on the lower surface 14*f* of the dielectric substrate 12.

As shown in FIG. 1, an NC terminal (a terminal not connected to an internal electrode) 16*a*, an unbalanced input/output terminal 16*b*, and a direct-current voltage input terminal (DC input terminal) 16*c* are disposed on the first side surface 14*a*. A ground terminal 16*d*, a first balanced input/output terminal 16*e*, and a second balanced input/output terminal 16*f* are disposed on the second side surface 14*b* (a side surface which is opposite to the first side surface 14*a*).

The unbalanced input/output terminal 16*b*, the DC input terminal 16*c*, the first balanced input/output terminal 16*e*, and the second balanced input/output terminal 16*f* are electrically insulated from the ground electrode 18 and the ground terminal 16*d* by exposed insulating areas of the dielectric substrate 12.

As shown in FIG. 2, the first through eleventh dielectric layers S1 through S11 are stacked successively downwardly in the order named. These first through eleventh dielectric layers S1 through S11 comprise a single layer or a plurality of layers each.

Of the first through eleventh dielectric layers S1. through S11, the sixth, ninth, and eleventh dielectric layers S6, S9, S11 have innerlayer ground electrodes 18*a*, 18*b*, 18*c* disposed on the respective principal surfaces thereof.

Within the dielectric substrate 12, there are disposed a filter 20, an unbalanced to balanced converter (hereinafter simply referred to as "converter") 22, and a connector 24 electrically interconnecting the filter 20 and the converter 22. The filter 20 has two ¼-wavelength resonators (a first resonator 26 and a second resonator 28). The converter 22 has a first stripline 30 disposed on a principal surface of the seventh dielectric layer S7 and second and third striplines 32, 34 disposed on a principal surface of the eighth dielectric layer S8.

The filter 20 and the converter 22 are disposed in respective upper and lower regions that are vertically separated in the laminated direction of the first through eleventh dielectric layers S1 through S11. For example, the filter 20 is disposed in the upper region and the converter 22 is disposed in the lower region with the connector 24 disposed therebetween.

The filter 20 is disposed in the first through fourth dielectric layers S1 through S4. The first resonator 26 is disposed closely to the first side surface 14*a*, and the second resonator 28 is disposed closely to the second side surface 14*b*.

As shown in FIG. 2, the first resonator 26 has an electrode 36 disposed on a principal surface of the fourth dielectric layer S4 and a via hole 38 extending through the first through third dielectric layers S1 through S3 and interconnecting the electrode 36 and the ground electrode 18. A lead electrode 40 is disposed on the principal surface of the fourth dielectric layer S4 and interconnects the electrode 36 and the unbalanced input/output terminal 16*b* (see FIG. 1).

Similarly, the second resonator 28 has an electrode 42 disposed on the principal surface of the fourth dielectric layer S4 and a via hole 44 extending through the first through third dielectric layers S1 through S3 and interconnecting the electrode 42 and the ground electrode 18.

The first resonator 26 is a ¼-wavelength resonator having the via hole 38 connected to the ground electrode 18, and the second resonator 28 is a ¼-wavelength resonator having the via hole 44 connected to the ground electrode 18. The first and second resonators 26, 28 are disposed between the ground electrode 18 and the innerlayer ground electrode 18*a* and extend perpendicularly to the ground electrode 18 and the innerlayer ground electrode 18*a*. Ends of the first and second resonators 26, 28 which are connected to the ground electrode 18 serve as short-circuited ends of the first and second resonators 26, 28. Portions, which face the innerlayer ground electrode 18*a*, of the electrodes 36, 42 which are disposed in facing relation to the innerlayer ground electrode 18*a* serve as open ends of the first and second resonators 26, 28. In other words, the ground electrode which provides the short-circuited ends of the first and second resonators 26, 28, and the ground electrode which faces the open ends of the first and second resonators 26, 28 are different from each other (the ground electrode 18 and the innerlayer ground electrode 18*a*).

Two degree-of-coupling adjustment electrodes 46, 48 for adjusting the electromagnetic coupling between the first resonator 26 and the second resonator 28 are disposed centrally on a principal surface of the third dielectric layer S3. The degree-of-coupling adjustment electrode 46 is disposed in a portion facing the electrodes 36, 42 of the first and second resonators 26, 28 closely to the third side surface 14*c*. The other degree-of-coupling adjustment electrode 48 is disposed in a portion facing the electrodes 36, 42 of the first and second resonators 26, 28 closely to the fourth side surface 14*d*.

The connector 24 has a capacitive electrode 50 disposed on a principal surface of the fifth dielectric layer S5 at a position corresponding to the electrode 42 of the second resonator 28, and a via hole 52 extending from an end of the capacitive electrode 50 through the fifth and sixth dielectric layers S5, S6 and connected to the first stripline 30 of the converter 22.

The first stripline 30 of the converter 22 is of such a shape that it diverges spirally from a starting end 54 and converges spirally to a terminal end 56 disposed at a position which is in line symmetry relation to the starting end 54 (a position in line symmetry with respect to a bisector m (typically shown on the seventh dielectric layer S7) of a line segment interconnecting the first and second balanced input/output terminals 16*e*, 16*f*). Since the first stripline 30 is of a line symmetry shape with respect to the bisector m, it provides signal characteristics which are balanced in phase and amplitude.

The via hole 52 of the connector 24 is connected to the first stripline 30 at the starting end 54 or near the starting end 54. In the description which follows, the position on the first stripline 30 where the via hole 52 is connected thereto is referred to as a first connected position 58.

The innerlayer ground electrode 18*a* on the principal surface of the sixth dielectric layer S6 has an insulating region 60 (an electrode-free region where the dielectric material is exposed) facing the first connected position 58 on the first stripline 30 for providing insulation between the innerlayer ground electrode 18*a* and the via hole 52.

The second stripline 32 of the converter 22 is of such a shape that it diverges spirally from a starting end 62 corresponding to the starting end 54 of the first stripline 30 toward the first balanced input/output terminal 16*e* (see FIG. 1), and has a terminal end 64 connected to the first balanced input/output terminal 16*e*.

The third stripline 34 is of such a shape that it diverges spirally from a starting end 66 corresponding to the terminal end 56 of the first stripline 30 toward the second balanced input/output terminal 16*f* (see FIG. 1), and has a terminal end 68 connected to the second balanced input/output terminal 16*f*.

The spiral shapes of the second and third striplines 32, 34 are in line symmetry relation to each other (in line symmetry with respect to the bisector m), and have respective physical lengths that are substantially the same as each other.

A DC electrode 70 is disposed on a principal surface of the tenth dielectric layer S10. The DC electrode 70 is electrically connected to the DC input terminal 16*c* (see FIG. 1) by a lead electrode 72.

The DC electrode 70 and the starting end 62 of the second stripline 32 or a position thereon near the starting end 62 are connected to each other by a via hole 74, and the DC electrode 70 and the starting end 66 of the third stripline 34 or a position thereon near the starting end 66 are connected to each other by a via hole 76. In the description which follows, the position on the second stripline 32 where the via hole 74 is connected thereto is referred to as a second connected position 78, and the position on the third stripline 34 where the via hole 76 is connected thereto is referred to as a third connected position 80.

The innerlayer ground electrode 18*b* on the principal surface of the ninth dielectric layer S9 has two insulating regions 82, 84 (electrode-free regions where the dielectric material is exposed) facing the second connected position 78 on the second stripline 32 and the third connected position 80 on the third stripline 34, respectively, for providing insulation between the innerlayer ground electrode 18*b* and the via holes 74, 76.

The innerlayer ground electrode 18*b* also functions as a shield electrode for providing isolation between the first through third striplines 30, 32, 34 and the DC electrode 70.

In the passive part 10A according to the first embodiment, as described above, the first and second resonators 26, 28 have the respective via holes 38, 44. Since the via holes 38, 44 are connected to the ground electrode 18 on the upper surface of the dielectric substrate 12, no stray capacitance is produced between the via holes 38, 44 and the ground electrode 18. Furthermore, since the via holes 38, 44 can be of a greater cross-sectional area than planar electrodes, they cause a correspondingly smaller conductor loss, resulting in a higher resonator Q value. There is no need to increase the thickness of the dielectric material included in the filter 20. Accordingly, the passive part 10A wherein the filter 20 and the converter 22 are integrally combined with each other can be made smaller in size.

Particularly in the passive part 10A according to the first embodiment, as the electrodes 36, 42 of the first and second resonators 26, 28 and the innerlayer ground electrode 18*a* are disposed in facing relation to each other with a dielectric material (the fourth and fifth dielectric layers S4, S5) interposed therebetween, a capacitance is provided between GND (ground) and the first and second resonators 26, 28. The ground electrode (a ground electrode as a triplate) for providing the filter 20 and the innerlayer ground electrode for providing isolation between the filter 20 and the converter 22 are provided as a common electrode, so that the various electrodes disposed in the dielectric substrate 12 are efficiently placed in position.

In the above embodiment, the capacitive electrode 50 is disposed in the connector 24, and the electrode 42 of the second resonator 28 and the first stripline 30 of the converter 22 are connected to each other by the via hole 52 through the capacitance. Alternatively, the electrode 42 of the second resonator 28 and the first stripline 30 of the converter 22 may be connected to each other directly by the via hole 52.

A passive part 10B according to a second embodiment of the present invention will be described below with reference to FIG. 3. Those parts of the second embodiment which correspond to those of the first embodiment are denoted by identical reference characters, and will not be described below.

Figure 3:
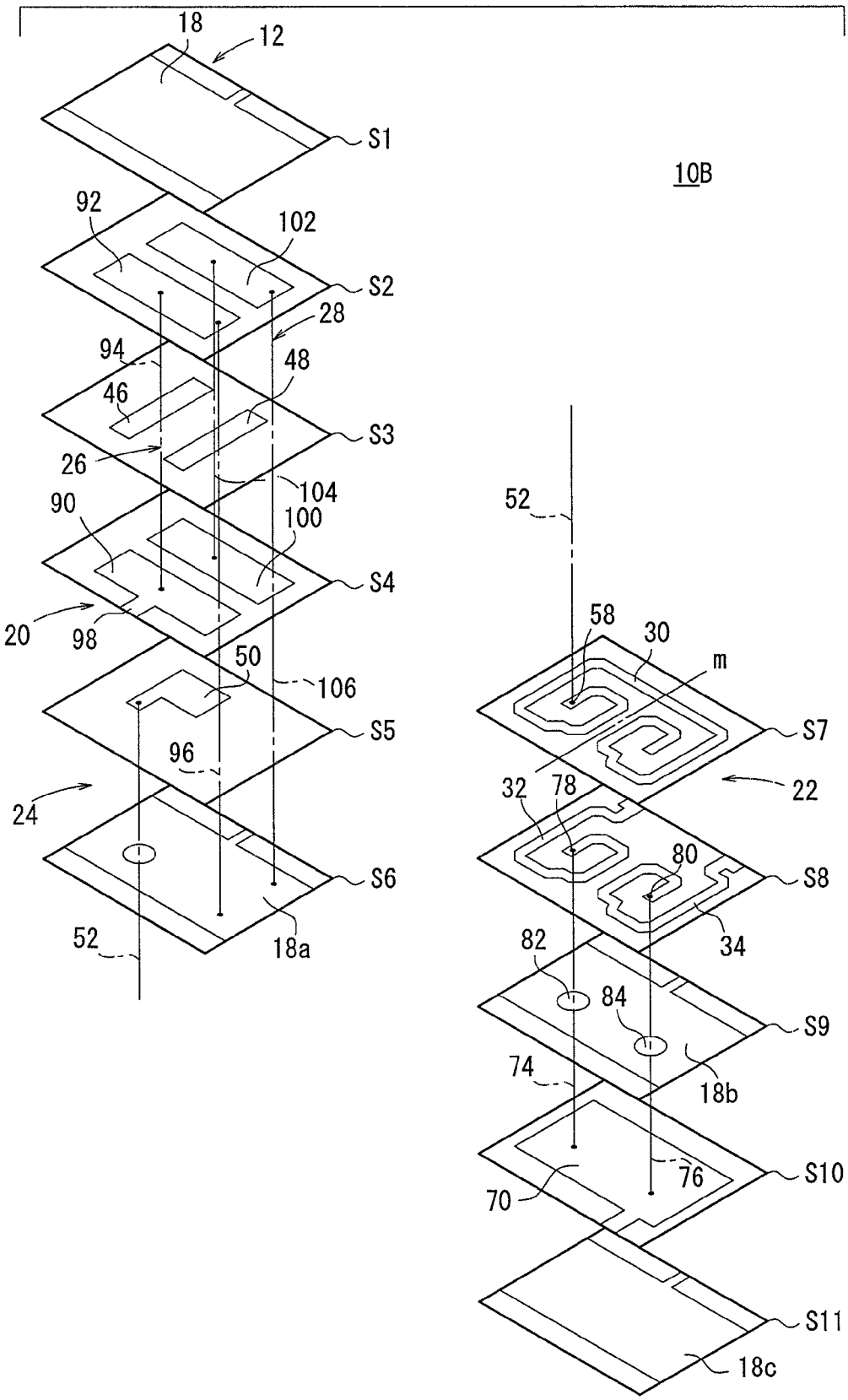
FIG. 3 is an exploded perspective view of a passive part according to a second embodiment of the present invention.

The passive part 10B according to the second embodiment is of a structure which is substantially the same as the passive part 10A according to the first embodiment described above, but differs therefrom as to the structure of the first and second resonators 26, 28, as follows:

As shown in FIG. 3, the first resonator 26 has a first electrode 90 disposed on the principal surface of the fourth dielectric layer S4, a second electrode 92 disposed on the principal surface of the second dielectric layer S2, a first via hole 94 extending through the second and third dielectric layers S2, S3 and interconnecting the first and second electrodes 90, 92, and a second via hole 96 extending through the second through fifth dielectric layers S2 through S5 and interconnecting the second electrode 92 and the innerlayer ground electrode 18*a*. A lead electrode 98 is disposed on the principal surface of the fourth dielectric layer S4 and interconnects the first electrode 90 and the unbalanced input/output terminal 16*b* (see FIG. 1).

Similarly, the second resonator 28 has a first electrode 100 disposed on the principal surface of the fourth dielectric layer S4, a second electrode 102 disposed on the principal surface of the second dielectric layer S2, a first via hole 104 extending through the second and third dielectric layers S2, S3 and interconnecting the first and second electrodes 100, 102, and a second via hole 106 extending through the second through fifth dielectric layers S2 through S5 and interconnecting the second electrode 102 and the innerlayer ground electrode 18*a*.

The first resonator 26 is a ¼-wavelength resonator having the first and second via holes 94, 96, and the second resonator 28 is a ¼-wavelength resonator having the first and second via holes 104, 106. The first and second resonators 26, 28 are disposed between the ground electrode 18 and the innerlayer ground electrode 18*a* and extend perpendicularly to the ground electrode 18 and the innerlayer ground electrode 18*a*. The first and second resonators 26, 28 are of a folded structure. Ends of the first and second resonators 26, 28 which are connected to the ground electrode 18 serve as short-circuited ends of the first and second resonators 26, 28. Portions, which face the innerlayer ground electrode 18*a*, of the electrodes 90, 100 which are disposed in facing relation to the innerlayer ground electrode 18*a* serve as open ends of the first and second resonators 26, 28. In other words, the ground electrode which provides the short-circuited ends of the first and second resonators 26, 28, and the ground electrode which faces the open ends of the first and second resonators 26, 28 are the same as each other (the innerlayer ground electrode 18*a*).

In the passive part 10B according to the second embodiment, since the first resonator 26 is of a folded structure provided by the first and second via holes 94, 96, and the second resonator 28 is of a folded structure provided by the first and second via holes 104, 106, a required resonator length is achieved for a sufficiently lower resonant frequency even if the passive part 10B is small in size.

A passive part 10C according to a third embodiment of the present invention will be described below with reference to FIGS. 4 and 5.

Figure 4:
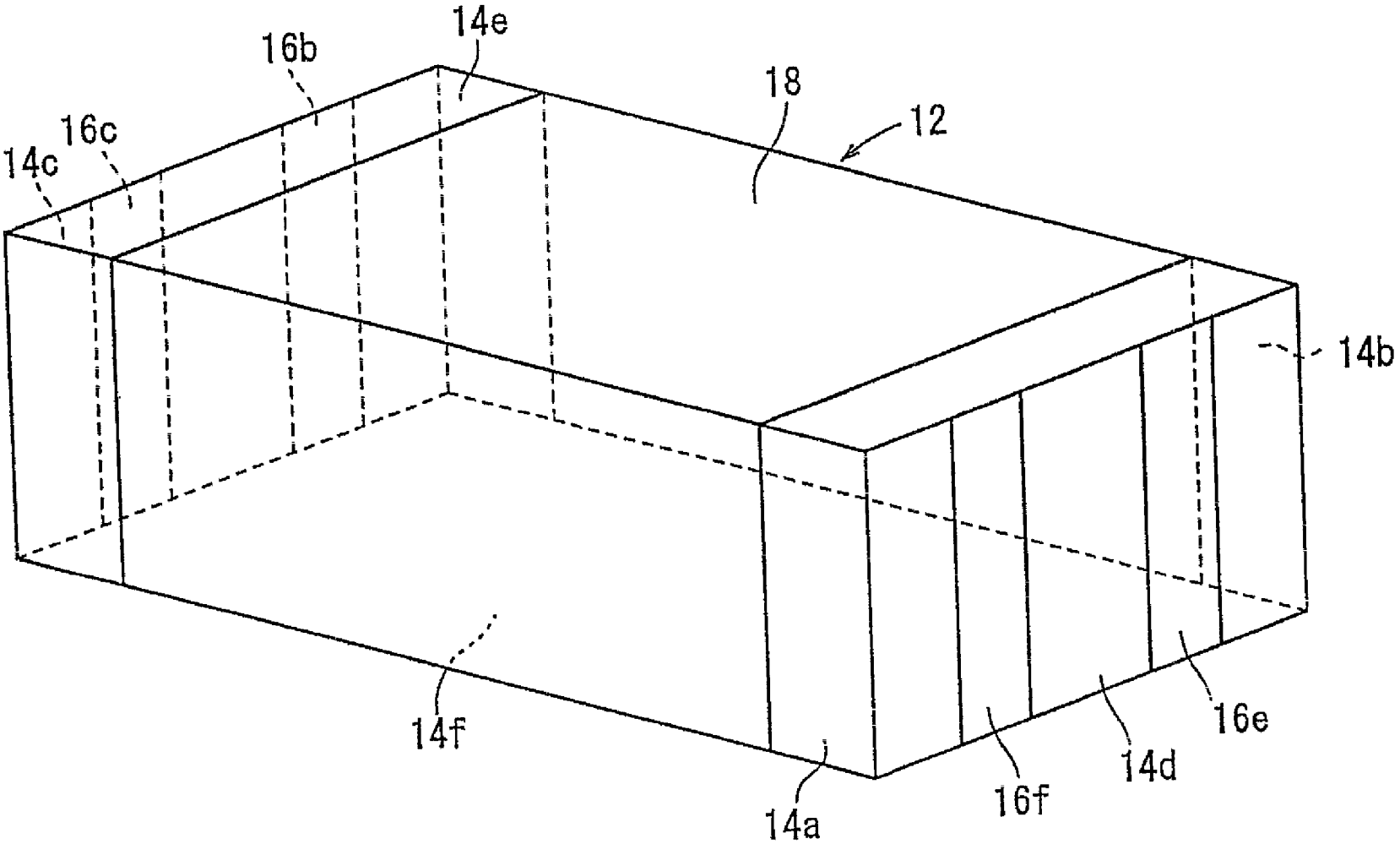
FIG. 4 is a perspective view of a passive part according to a third embodiment of the present invention.
Figure 5:
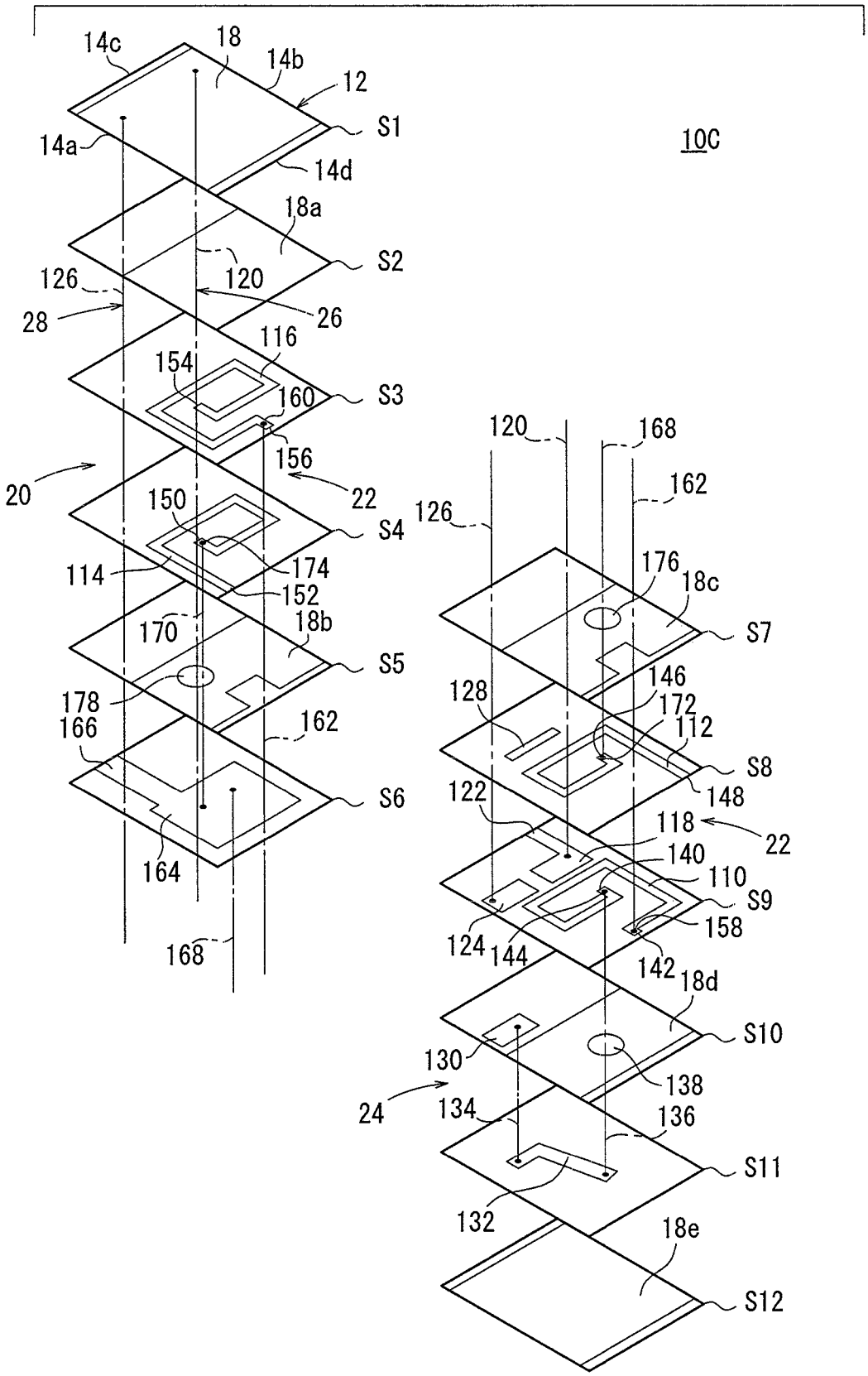
FIG. 5 is an exploded perspective view of the passive part according to the third embodiment.

As shown in FIGS. 4 and 5, the passive part 10C according to the third embodiment has a dielectric substrate 12 comprising a plurality of dielectric layers S1 through S12 (see FIG. 5) which are laminated and baked integrally together. The dielectric substrate 12 has six outer peripheral surfaces (first through fourth side surfaces 14*a* through 14*d*, an upper surface 14*e*, and a lower surface 14*f*). A ground electrode 18 is disposed substantially entirely on the first and second side surfaces 14*a*, 14*b* and the upper surface 14*e* in covering relation to the dielectric substrate 12. According to the third embodiment, an innerlayer ground electrode is disposed on a principal surface of the lowermost dielectric layer S12. Alternatively, a ground electrode may be disposed on the lower surface of the dielectric substrate 12.

As shown in FIG. 4, an unbalanced input/output terminal 16*b* and a DC input terminal 16*c* are disposed on the third side surface 14*c*. A first balanced input/output terminal 16*e* and a second balanced input/output terminal 16*f* are disposed on the fourth side surface 14*d* (a side surface which is opposite to the third side surface 14*c*).

The unbalanced input/output terminal 16*b*, the DC input terminal 16*c*, the first balanced input/output terminal 16*e*, and the second balanced input/output terminal 16*f* are electrically insulated from the ground electrode 18 by exposed insulating areas of the dielectric substrate 12.

As shown in FIG. 5, the first through twelfth dielectric layers S1 through S12 are stacked successively downwardly in the order named. These first through twelfth dielectric layers S1 through S12 comprise a single layer or a plurality of layers each.

Of the first through twelfth dielectric layers S1 through S12, the second, fifth, seventh, and tenth dielectric layers S2, S5, S7, S10 have innerlayer ground electrodes 18*a*, 18*b*, 18*c*, 18*d* disposed on the respective principal surfaces thereof close to the fourth side surface 14*d*. An innerlayer ground electrode 18*e* is disposed substantially entirely on a principal surface of the twelfth dielectric layer S12.

According to the third embodiment, a filter 20, a converter 22, and a connector 24 are disposed within the dielectric substrate 12. The filter 20 has a first resonator 26 and a second resonator 28. The converter 22 has a first stripline 110 disposed on a principal surface of the ninth dielectric layer S9, a second stripline 112 disposed on a principal surface of the eighth dielectric layer S8, a third stripline 114 disposed on a principal surface of the fourth dielectric layer S4, and a fourth stripline 116 disposed on a principal surface of the third dielectric layer S3.

The filter 20 is disposed in a right or left portion of the dielectric substrate 12, and the converter 22 is disposed in a right or left portion of the dielectric substrate 12. In FIG. 5, the filter 20 is disposed in the left portion of the dielectric substrate 12, the converter 22 is disposed in the right portion of the dielectric substrate 12, and the connector 24 is disposed in a lower portion of the dielectric substrate 12.

The first resonator 26 has an electrode 118 disposed on the principal surface of the ninth dielectric layer S9 and a via hole 120 extending through the first through eighth dielectric layers S1 through S8 and interconnecting the electrode 118 and the ground electrode 18. A lead electrode 122 is disposed on the principal surface of the ninth dielectric layer S9 and interconnects the electrode 118 and the unbalanced input/output terminal 16*b* (see FIG. 4).

Similarly, the second resonator 28 has an electrode 124 disposed on the principal surface of the ninth dielectric layer S9 and a via hole 126 extending through the first through eighth dielectric layers S1 through S8 and interconnecting the electrode 124 and the ground electrode 18.

The first resonator 26 is a ¼-wavelength resonator having the via hole 120 connected to the ground electrode 18, and the second resonator 28 is a ¼-wavelength resonator having the via hole 126 connected to the ground electrode 18. The first and second resonators 26, 28 are disposed between the ground electrode 18 and the innerlayer ground electrode 18*e* and extend perpendicularly to the ground electrode 18 and the innerlayer ground electrode 18*e*. Ends of the first and second resonators 26, 28 which are connected to the ground electrode 18 serve as short-circuited ends of the first and second resonators 26, 28. Portions, which face the innerlayer ground electrode 18*e*, of the electrodes 118, 124 which are disposed in facing relation to the innerlayer ground electrode 18*e* serve as open ends of the first and second resonators 26, 28. In other words, the ground electrode which provides the short-circuited ends of the first and second resonators 26, 28, and the ground electrode which faces the open ends of the first and second resonators 26, 28 are different from each other (the ground electrode 18 and the innerlayer ground electrode 18*e*).

A degree-of-coupling adjustment electrode 128 for adjusting the electromagnetic coupling between the first resonator 26 and the second resonator 28 is disposed on the principal surface of the eighth dielectric layer S8 closely to the third side surface 14*c*. The degree-of-coupling adjustment electrode 128 extends continuously between a portion facing the electrode 118 of the first resonator 26 and a portion facing the electrode 124 of the second resonator 28.

The connector 24 has a capacitive electrode 130, a connecting electrode 132, and two via holes 134, 136. The capacitive electrode 130 is disposed on a portion of the principal surface of the tenth dielectric layer S10 which corresponds to the electrode 124 of the second resonator 28. The connecting electrode 132 is disposed on a principal surface of the eleventh dielectric layer S11. An end of the connecting electrode 132 and the capacitive electrode 130 are connected to each other by the via hole 134 which extends through the tenth dielectric layer S10. The connecting electrode 132 and the first stripline 110 of the converter 22 are connected to each other by the via hole 136 which extends through the ninth and tenth dielectric layers S9, S10. The innerlayer ground electrode 18*d* has a region 138 (an electrode-free region) where the via hole 136 extends therethrough for providing insulation between the innerlayer ground electrode 18*d* and the via hole 136.

The first stripline 110 of the converter 22 is of a spiral shape extending from a starting end 140 positioned substantially centrally on the ninth dielectric layer S9 to a terminal end 142 positioned on the ninth dielectric layer S9 closely to the fourth side surface 14*d*. The via hole 136 of the connector 24 is connected to the first stripline 110 at a position at the starting end 140 or near the starting end 140. In the description which follows, the position on the first stripline 110 where the via hole 136 is connected thereto is referred to as a first connected position 144.

The second stripline 112 of the converter 22 is disposed on the principal surface of the eighth dielectric layer S8, and is of a spiral shape extending from a starting end 146 corresponding to the starting end 140 of the first stripline 110 to the first balanced input/output terminal 16*e* (see FIG. 4). The second stripline 112 has a terminal end 148 connected to the first balanced input/output terminal 16*e*.

The third stripline 114 is of such a shape that it diverges spirally from a starting end 150 positioned substantially centrally on the fourth dielectric layer S4 to the second balanced input/output terminal 16*f* (see FIG. 4). The third stripline 114 has a terminal end 152 connected to the second balanced input/output terminal 16*f*.

The fourth stripline 116 is disposed on the principal surface of the third dielectric layer S3, and is of a spiral shape extending from a starting end 154 corresponding to the starting end 150 of the third stripline 114 to a terminal end 156 positioned on the third dielectric layer S3 near the fourth side surface 14*d*. The terminal end 142 of the first stripline or a position (a connected position 158) near the terminal end 142 and the terminal end 156 of the fourth stripline or a position (a connected position 160) near the terminal end 156 are connected to each other by a via hole 162 extending through the third through eighth dielectric layers S3 through S8.

A DC electrode 164 is disposed on a principal surface of the sixth dielectric layer S6. The DC electrode 164 is electrically connected to the DC input terminal 16*c* (see FIG. 4) by a lead electrode 166.

The DC electrode 164 and the starting end 146 of the second stripline 112 or a position near the starting end 146 are connected to each other by a via hole 168, and the DC electrode 164 and the starting end 150 of the third stripline 114 or a position near the starting end 150 are connected to each other by a via hole 170. In the description which follows, the position on the second stripline 112 where the via hole 168 is connected thereto is referred to as a second connected position 172, and the position on the third stripline 114 where the via hole 170 is connected thereto is referred to as a third connected position 174.

The innerlayer ground electrode 18*c* on the principal surface of the seventh dielectric layer S7 has an insulating region 176 (an electrode-free region where the dielectric material is exposed) facing the second connected position 172 on the second stripline 112 for providing insulation between the innerlayer ground electrode 18*c* and the via hole 168.

Similarly, the innerlayer ground electrode 18*b* on the principal surface of the fifth dielectric layer S5 has an insulating region 178 (an electrode-free region where the dielectric material is exposed) facing the third connected position 174 on the third stripline 114 for providing insulation between the innerlayer ground electrode 18*b* and the via hole 170.

The innerlayer ground electrode 18*c* functions as a shield electrode for providing isolation between the first and second striplines 110, 112 and the DC electrode 164. The innerlayer ground electrode 18*b* functions as a shield electrode for providing isolation between the third and fourth striplines 114, 116 and the DC electrode 164.

As with the first embodiment, the passive part 10C according to the third embodiment wherein the filter 20 and the converter 22 are integrally combined with each other can be made smaller in size.

According to the third embodiment, the filter 20 is disposed in the left portion of the dielectric substrate 12, and the converter 22 is disposed in the right portion of the dielectric substrate 12. Therefore, the dielectric material included in the filter 20 can have a sufficient thickness for a higher resonator Q value.

In the above embodiment, the capacitive electrode 130 is disposed in the connector 24, and the electrode 124 of the second resonator 28 and the first stripline 110 of the converter 22 are connected to each other by the via hole 136, the connecting electrode 132, and the via hole 134 through the capacitance. Alternatively, the capacitive electrode 130 may be dispensed with, and the electrode 124 of the second resonator 28 and the first stripline 110 of the converter 22 may be connected to each other by the via hole 136, the connecting electrode 132, and the via hole 134.

A passive part 10D according to a fourth embodiment of the present invention will be described below with reference to FIG. 6. Those parts of the fourth embodiment which correspond to those of the third embodiment are denoted by identical reference characters, and will not be described below.

Figure 6:
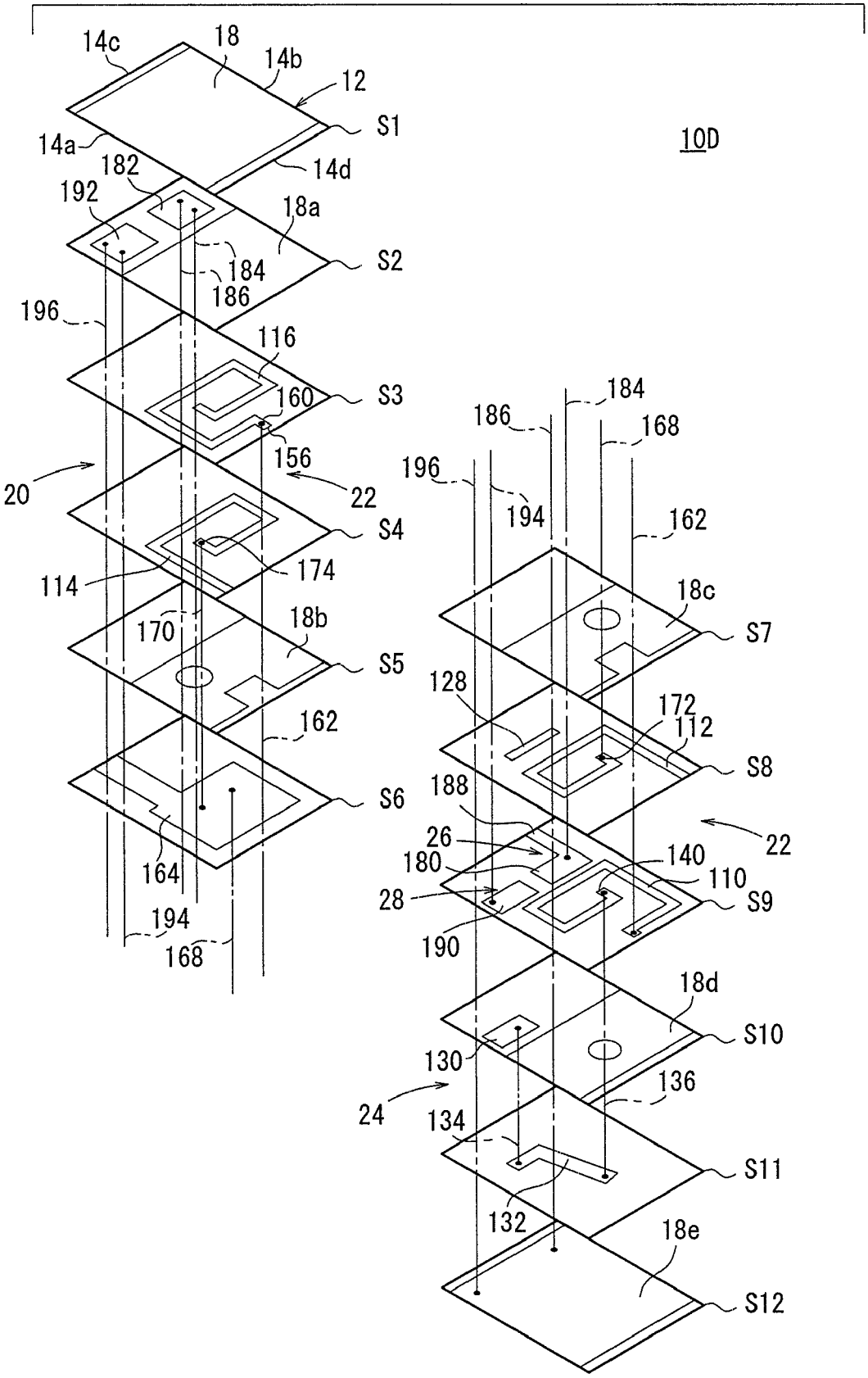
FIG. 6 is an exploded perspective view of a passive part according to a fourth embodiment of the present invention.

The passive part 10D according to the fourth embodiment is of a structure which is substantially the same as the passive part 10C according to the third embodiment described above, but differs therefrom as to the structure of the first and second resonators 26, 28, as follows:

As shown in FIG. 6, the first resonator 26 has a first electrode 180 disposed on the principal surface of the ninth dielectric layer S9, a second electrode 182 disposed on the principal surface of the second dielectric layer S2, a first via hole 184 extending through the second through eighth dielectric layers S2 through S8 and interconnecting the first and second electrodes 180, 182, and a second via hole 186 extending through the second through eleventh dielectric layers S2 through S11 and interconnecting the second electrode 192 and the innerlayer ground electrode 18*e*. A lead electrode 188 is disposed on the principal surface of the ninth dielectric layer S9 and interconnects the first electrode 180 and the unbalanced input/output terminal 16*b* (see FIG. 4).

Similarly, the second resonator 28 has a first electrode 190 disposed on the principal surface of the ninth dielectric layer S9, a second electrode 192 disposed on the principal surface of the second dielectric layer S2, a first via hole 194 extending through the second through eighth dielectric layers S2 through S8 and interconnecting the first and second electrodes 190, 192, and a second via hole 196 extending through the second through eleventh dielectric layers S2 through S11 and interconnecting the second electrode 192 and the innerlayer ground electrode 18*e*.

In the passive part 10D according to the fourth embodiment, since the first resonator 26 is of a folded structure provided by the first and second via holes 184, 186, and the second resonator 28 is of a folded structure provided by the first and second via holes 194, 196, a required resonator length is achieved for a sufficiently lower resonant frequency even if the passive part 10D is small in size.

In the above embodiments, the filter 20 has the two resonators 26, 28. However, the present invention is also applicable to a passive part where the filter 20 has one resonator or three or more resonators.

The passive part according to the present invention is not limited to the above embodiments, but may take various structures without departing from the scope of the invention.

The invention claimed is:

1. A passive part comprising, in a dielectric substrate, a filter, an unbalanced to balanced converter, and a connector electrically interconnecting the filter and the unbalanced to balanced converter, wherein said filter is disposed in an upper portion of said dielectric substrate and said unbalanced to balanced converter is disposed in a lower portion of said dielectric substrate, or said filter is disposed in the lower portion of said dielectric substrate and said unbalanced to balanced converter is disposed in the upper portion of said dielectric substrate;

a first ground electrode is disposed on a surface of said dielectric substrate close to said filter, and a second ground electrode is disposed on a surface of said dielectric substrate close to said unbalanced to balanced converter;

an innerlayer ground electrode is disposed between said filter and said unbalanced to balanced converter;

said filter has at least one resonator;

said resonator has a via hole having one end connected to said first ground electrode, and an electrode connected to the other end of said via hole and positioned across a dielectric material from said innerlayer ground electrode;

said via hole comprises a resonant electrode;

a portion, which faces said innerlayer ground electrode of said electrode, serves as an open end of said resonator; and a portion of said via hole, which is connected to said first ground electrode, serves as a short-circuited end of said resonator.

2. A passive part according to claim 1, wherein said connector comprises:

a via hole electrically connected to said electrode of said resonator and extending through said innerlayer ground electrode, said via hole having an end connected to said unbalanced to balanced converter.

3. A passive part according to claim 1, wherein said connector comprises:

a capacitive electrode disposed across a dielectric material from said electrode of said resonator; and a via hole connected to said capacitive electrode and extending through said innerlayer ground electrode, said via hole having an end connected to said unbalanced to balanced converter.

4. A passive part comprising, in a dielectric substrate, a filter, an unbalanced to balanced converter, and a connector electrically interconnecting the filter and the unbalanced to balanced converter, wherein said filter is disposed in a left portion of said dielectric substrate and said unbalanced to balanced converter is disposed in a right portion of said dielectric substrate, or said filter is disposed in the right portion of said dielectric substrate and said unbalanced to balanced converter is disposed in the left portion of said dielectric substrate;

a first ground electrode is disposed in an upper portion of said dielectric substrate, and a second ground electrode is disposed in a lower portion of said dielectric substrate;

said filter has at least one resonator; and said resonator has a via hole having one end connected to said first ground electrode, and an electrode connected to the other end of said via hole and disposed across a dielectric material from said second ground electrode;

said via hole comprises a resonant electrode;

a portion, which faces said second ground electrode of said electrode serves as an open end of said resonator; and a portion of said via hole, which is connected to said first ground electrode, serves as a short-circuited end of said resonator.

5. A passive part according to claim 4, wherein said connector comprises:

a connecting electrode having one end electrically connected to said electrode of said resonator and the other end connected to said unbalanced to balanced converter;

wherein an innerlayer ground electrode is disposed between said connecting electrode and said unbalanced to balanced converter.

6. A passive part according to claim 4, wherein said connector comprises:

a capacitive electrode disposed across a dielectric material from said electrode of said resonator; and a connecting electrode having one end connected to said capacitive electrode and the other end connected to said unbalanced to balanced converter;

wherein an innerlayer ground electrode is disposed between said connecting electrode and said unbalanced to balanced converter.

7. A passive part comprising, in a dielectric substrate, a filter, an unbalanced to balanced converter, and a connector electrically interconnecting the filter and the unbalanced to balanced converter, wherein said filter is disposed in a left portion of said dielectric substrate and said unbalanced to balanced converter is disposed in a right portion of said dielectric substrate, or said filter is disposed in the right portion of said dielectric substrate and said unbalanced to balanced converter is disposed in the left portion of said dielectric substrate;

a first ground electrode is disposed in an upper portion of said dielectric substrate, and a second ground electrode is disposed in a lower portion of said dielectric substrate;

said filter has at least one resonator;

said resonator has a first via hole, a first electrode connected to one end of said first via hole and disposed in facing relation to said second ground electrode, a second electrode connected to the other end of said first via hole and disposed across a dielectric material from said first ground electrode, and a second via hole having one end connected to said second electrode and the other end connected to said second ground electrode;

one resonant electrode is constructed of said first via hole, said second electrode and said second via hole;

a portion of said first electrode, which faces said second ground electrode, serves as an open end of said resonator; and a portion of said second via hole, which is connected to said second ground electrode, serves as a short-circuited end of said resonator.

8. A passive part according to claim 7, wherein said connector comprises:

a connecting electrode having one end electrically connected to said first electrode of said resonator and the other end connected to said unbalanced to balanced converter;

wherein an innerlayer ground electrode is disposed between said connecting electrode and said unbalanced to balanced converter.

9. A passive part according to claim 7, wherein said connector comprises:

a capacitive electrode disposed across a dielectric material from said first electrode of said resonator; and a connecting electrode having one end connected to said capacitive electrode and the other end connected to said unbalanced to balanced converter;

wherein an innerlayer ground electrode is disposed between said connecting electrode and said unbalanced to balanced converter.

* * * * *